US008717173B2

(12) United States Patent
Jones

(10) Patent No.: US 8,717,173 B2
(45) Date of Patent: May 6, 2014

(54) DIGITAL DISC ALARM

(76) Inventor: Mary L. Jones, Athens, TX (US)

( * ) Notice: Subject to any disclaimer, the term of this patent is extended or adjusted under 35 U.S.C. 154(b) by 749 days.

(21) Appl. No.: 12/903,483

(22) Filed: Oct. 13, 2010

(65) Prior Publication Data

US 2012/0092165 A1 Apr. 19, 2012

(51) Int. Cl.

| | |
|---|---|
| ***G08B 13/14*** | (2006.01) |
| ***G08B 13/08*** | (2006.01) |
| ***G08B 21/00*** | (2006.01) |

(52) U.S. Cl.

USPC ..... 340/571; 340/545.6; 340/572.1; 340/572.3; 340/572.8; 340/686.1

(58) Field of Classification Search

USPC ..... 40/124.03; 340/571, 686.1–687, 545.6, 340/568.8

See application file for complete search history.

(56) References Cited

U.S. PATENT DOCUMENTS

| | | | | |
|---|---|---|---|---|
| 1,081,150 | A | 12/1913 | Head | |
| 2,810,361 | A | 10/1957 | Carey | |
| 3,922,672 | A | 11/1975 | Birt | |
| 3,974,492 | A | 8/1976 | Girismen | |
| 4,104,628 | A | 8/1978 | Sweany et al. | |
| 4,117,468 | A | 9/1978 | Vasquez | |
| 4,155,457 | A | 5/1979 | Wilbert | |
| 4,190,828 | A | 2/1980 | Wolf | |
| 4,194,193 | A | 3/1980 | McDonough | |
| 4,633,232 | A | 12/1986 | Nelson | |
| 4,841,285 | A | 6/1989 | Laut | |
| 5,434,559 | A | 7/1995 | Smilev et al. | |
| 5,515,032 | A | 5/1996 | Johnson | |
| 5,805,066 | A * | 9/1998 | Murdy | 340/568.1 |
| 5,838,225 | A | 11/1998 | Todd | |
| 5,963,131 | A | 10/1999 | D'Angelo et al. | |
| 6,104,306 | A * | 8/2000 | Hogue et al. | 340/686.1 |
| 6,133,830 | A | 10/2000 | D'Angelo et al. | |
| 6,380,856 | B1 | 4/2002 | Johnson et al. | |
| 6,420,969 | B1 | 7/2002 | Campbell | |
| 2002/0175818 | A1 * | 11/2002 | King et al. | 340/572.8 |
| 2005/0205442 | A1 * | 9/2005 | Spagna | 206/308.2 |
| 2010/0033329 | A1 * | 2/2010 | Davis et al. | 340/571 |
| 2010/0188227 | A1 * | 7/2010 | Yang | 340/572.1 |
| 2011/0113437 | A1 * | 5/2011 | Day | 720/728 |
| 2012/0256748 | A1 * | 10/2012 | Russell | 340/572.1 |

* cited by examiner

*Primary Examiner* — Benjamin C Lee
*Assistant Examiner* — Adam Carlson

(57) ABSTRACT

An alarm for digital storage discs includes an alarm module positioned within the central indention found in conventional CD and DVD jewel cases. A lid sensor in communication with the alarm module includes a pair of spaced trigger arms that form an ovate opening. A nodule on the uppermost arm engages the jewel case lid to maintain engagement of electrical contacts on the arms. An arming switch includes a magnetically-operated pin that is extended into the opening formed between the triggers to prevent the contacts from separating. Once the jewel case is sealed, an arming station initially retracts the pin while the case lid firmly engages the nodule to maintain the contacts in engagement. If an unauthorized user opens the jewel case without first extending the pin at the arming station, the triggers will automatically separate thereby activating the alarm.

17 Claims, 4 Drawing Sheets

DIGITAL DISC ALARM

BACKGROUND OF THE INVENTION

The present invention relates to an alarm for preventing theft of digital storage discs such as DVD's and CD's.

DESCRIPTION OF THE PRIOR ART

Retailers suffer tremendous losses each year due to thefts of compact discs (CD's) and digital versatile discs (DVD's). Often, the disc jewel cases are enclosed within a theft-prevention frame that triggers an alarm if not removed by store personnel prior to the case passing a scanner. However, in order to circumvent the conventional alarm, thieves will remove the disc from the packaging and simply escape with the disc. Accordingly, there is currently a need for an improved alarm that prevents thieves from removing the disc from its packaging. The present invention addresses this need by providing an alarm that is activated whenever a jewel case is opened to alert those nearby of a possible theft.

SUMMARY OF THE INVENTION

The present invention relates to an alarm for digital storage discs including an alarm module positioned within the central indention typically found in conventional CD and DVD jewel cases. A lid sensor in communication with the alarm module includes a pair of spaced trigger arms that form an ovate opening A nodule on the uppermost arm engages the jewel case lid to maintain engagement of electrical contacts on the arms. An arming switch includes a magnetically-operated pin that is extended into the opening formed between the triggers to prevent the contacts from separating. Once the jewel case is sealed, an arming station initially retracts the pin while the case lid firmly engages the nodule to maintain the contacts in engagement. If an unauthorized user opens the jewel case without first extending the pin at the arming station, the triggers arms will automatically separate thereby activating the alarm.

It is therefore an object of the present invention to provide an alarm for preventing theft of digital data storage discs.

It is another object of the present invention to provide an alarm system that automatically alerts those nearby whenever a digital disc jewel case is opened by an unauthorized person.

Other objects, features, and advantages of the present invention will become readily apparent from the following detailed description of the preferred embodiment when considered with the attached drawings and the appended claims

DESCRIPTION OF THE PREFERRED EMBODIMENT

Figure 1:
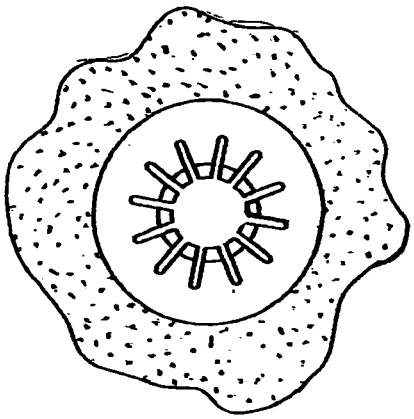
FIG. 1 is a top view of a typical digital-disc jewel case.
Figure 2:
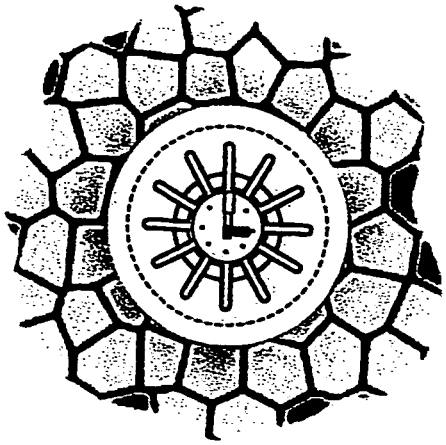
FIG. 2 is a top view of the case of FIG. 1 with the alarm according to the present invention installed therein.
Figure 3:
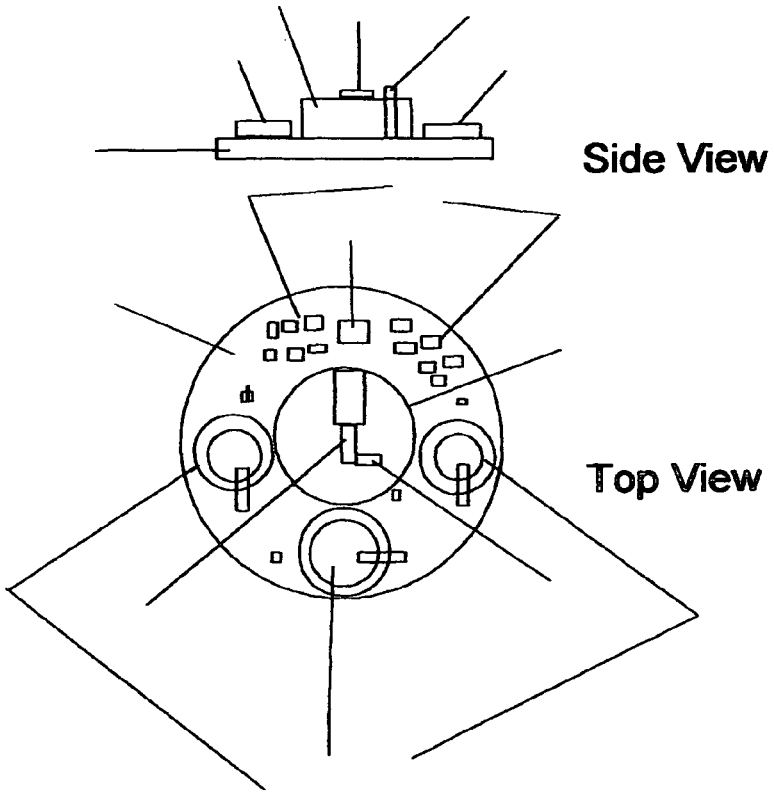
FIG. 3 is an isolated, view of the alarm module.
Figure 4:
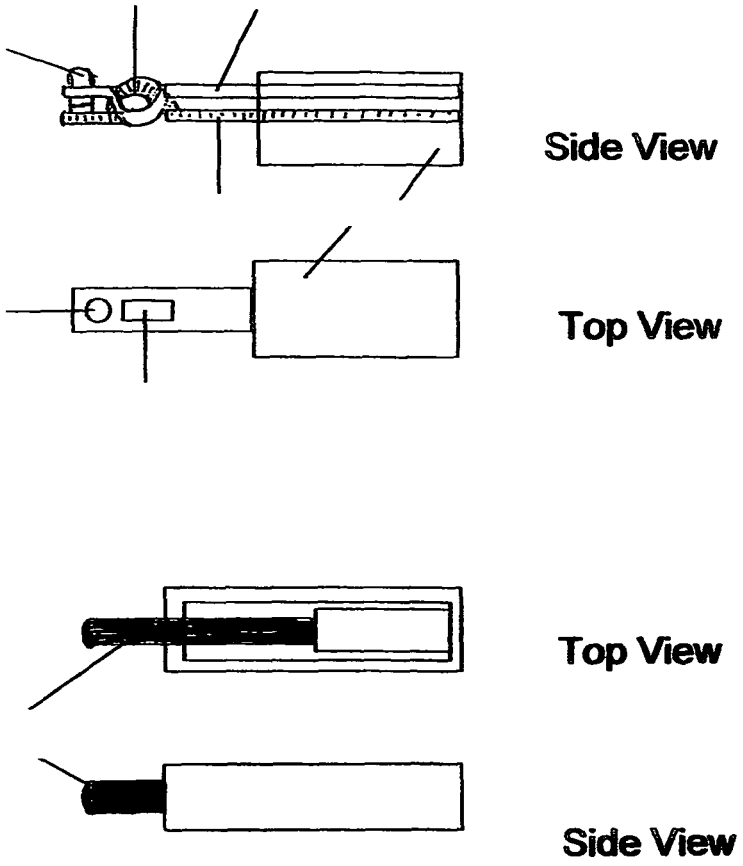
FIG. 4 is an isolated, view of the lid sensor and arming switch.

The present invention relates to an alarm for digital storage discs including an alarm module 1 formed of a circuit board having a piezo buzzer and microcontroller. The circuit board is substantially circular and is unobtrusively positioned within the central indention 2 found in conventional CD and DVD jewel cases. Adhesively secured to the buzzer is a lid sensor 3 in communication with the microcontroller that detects unauthorized opening of the jewel case lid. The sensor includes a small housing 4 having a pair of spaced trigger arms 5 extending therefrom. The arms each include a central notch 7 that cooperates with the other to form an ovate opening 6. A terminus on an upper arm has an electrical contact 8 on its lower surface for selectively engaging a similar contact 9 on the upper surface of the other arm. A nodule 10 on the upper surface of the upper arm terminus engages a jewel case lid to maintain engagement of the contacts. The contacts are in communication with the alarm module such that, if the contacts separate, the buzzer is activated.

A magnetic switch 11 arms the sensor allowing it to detect unauthorized entry into the jewel case. The switch includes a magnetically-operated pin 12 that is extended from and retracted within a casing. The casing is positioned such that, when the pin is extended, it fits within the opening formed by the trigger arm notches to prevent the contacts from separating.

An arming station having an electromagnet is positioned at a strategic Location within a retail outlet, such as near a cash register. When the jewel case is first closed and sealed with security tape, the case is scanned by the arming station to retract the pin. The case lid firmly engages the nodule to maintain the contacts in engagement thereby arming the alarm. If an unauthorized user opens the jewel case without first deactivating the alarm at the arming station, the triggers arms will automatically separate instructing the microprocessor to activate the buzzer. When a consumer legitimately purchases the disc, a cashier or other worker scans the jewel case to extend the pin into the opening formed between the trigger arms to prevent alarm activation.

The audible alarm device of the preferred embodiment is an in-store theft deterrent device whereby providing means for securing digital data storage discs or goods in cases and product boxes thereby preventing unlawful appropriation of said goods presented in an inexpensive, re-armable, easily constructed, simple device constructed of readily obtained materials designed to retain the disc on the center hub clips of the CD/DVD case in the usual manner and to fit snugly within the central indention of digital data storage cases which is approximately 1.00" in diameter by 0.100" deep. The center of the CD/DVD case is approximately 0.500" in diameter by 0.200" deep. The audible alarm device is disposed on the underside of product box lids, whereby such placement reduces or eliminates the need for additional protective cases or an alarm device in which digital data storage discs or goods are inserted or spider wrapped to reduce in-store theft of goods; said audible alarm device is adhered unobtrusively on the circuit board disc which contains all components of the device whereby the device may easily be inserted in the package or product box for digital data storage discs and various other types of goods.

In one embodiment, the printed circuit board is a standard 0.032" FR4 double sided printed circuit board. The printed circuit board may sit directly on the case, which acts as an insulator. In one embodiment, the case is made of plastic. The housing, which may also be referred to as the mounting base, is also made of plastic in the preferred embodiment. The printed circuit board and all electrical components associated with such, as mentioned above, are powered by way of a plurality of batteries included in the alarm device. The buzzer, which is a piezo buzzer in the preferred embodiment, can be implemented in connection to an amplifying unit. In the preferred embodiment, the piezo buzzer emits a minimum 80 dB sound at 4 kHz when activated, but can be configured to operate at any magnitude and frequency desired for the application.

In the preferred embodiment, a method for installing and using the alarm device is as follows: a. place the audible alarm device in the central indention of the jewel case or dispose on the underside of the product box lid, b. insert the digital data storage disc or goods into the package or product box, c. add magnetic security device strips, if desired, prior to closing the lid, d. close the lid and seal with security tape around the outside of the package or product box, e. the package or product box is shrink-wrapped, f. said audible alarm device is then armed at an arming station by the preferred arming method comprising: 1. said electromagnet retracts said pin while the case lid or product box lid firmly engages said nodule to maintain said contacts in engagement, 2. the audible alarm device activation occurs by passing the package or product box to the left over a strong electromagnetic force, 3. the audible alarm device deactivation occurs by passing the package or product box to the right over a strong magnetic force at a de-magnetizing station at the checkout stand, 4. once the package or product box has been scanned, the package or box is ready to shipped to the vendor.

The audible alarm device is an economical, simple-in-design, device designed for securing digital data storage discs or goods in conventional jewel cases and product boxes. The audible alarm design allows it to be inserted into packages or boxes as a means for preventing unlawful appropriation of digital data storage discs or goods whereby decreasing loss while increasing vendor revenue, yet the design allows for re-arming of the alarm by vendors, if desired, and the design also permits customer removal and disposal. The audible alarm device is easy to manufacture using the preferred embodiment, all components of said alarm are easily obtained and are economical in nature whereby the use of the alarm provides an economical solution for loss prevention aspects for vendors whereby vendors may add the alarm unit without affecting profitability thereby reducing or eliminating loss from pilfering by thieves attempting to shoplift while in the store; the sounding of the alarm alerts store personnel who respond to the alert thereby preventing the thief from absconding with the goods. The audible alarm device eliminates the need for additional separate theft prevention storage cases and spider wraps whereby providing an added cost benefit; the module production cost is small enough to allow the alarm unit to be added to the case or the product box without affecting profitability. An additional benefit of the audible alarm device is the adaptability of the alarm; while the embodiment described herein is limited to digital data storage discs or goods, it should be apparent there are many adaptations possible which are in the scope and spirit of the audible alarm device including a multitude of composites, dimensions and placements; said audible alarm device is not limited to the preferred embodiment.

The above-described device is not limited to the exact details of construction And enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

I claim:

1. An alarm device configured to detect and deter an unauthorized opening of a lid of a product container, the alarm device comprising:

a circuit board portion and a sensing unit mounted under the lid of the product container, the lid having an open state and a closed state detectable by the sensing unit;

an audible alarm mounted on the circuit board portion;

the sensing unit comprising:

first and second cantilevers that extend generally parallel to each other and outward from a mounting base, the first and second cantilevers comprising first anchored ends extending generally out of the mounting base and second non-anchored ends, the second non-anchored ends crisscrossed, bowed outwardly in a relatively opposed direction and crisscrossed again to form an ovate-shaped opening therebetween before finally ending parallel to each other again, the first cantilever at the second non-anchored end having a first electrical terminal and having a nodule on a top side thereof that abuts an inner surface of the lid when the product container is in the closed state and acts to push the first cantilever towards the second cantilever at the non-anchored ends, and wherein the second cantilever at the second non-anchored end comprises a second electrical terminal facing said first electrical terminal biased by the cantilevers in an electrically non-contacted state maintained so long as the lid is in the open state;

wherein if the lid is in the closed state, the lid presses against the nodule that in turn presses on the first cantilever's second non-anchored end such that the first and second facing electrical terminals are in an electrically-connected state;

a switching unit mounted on the circuit board portion and comprising a magnetically-operated pin capable of selectively extending into the ovate-shaped opening to lock the first and second electrical terminals of the first and second cantilevers into the electrically-connected state regardless of the open/closed state of the lid; and wherein the audible alarm is activated upon opening of the lid if the switching unit does not have the magnetically-operated pin selectively extended into said ovate-shaped opening, and responsive to the first and second electrical terminals being in the electrically non-contacted state.

2. The alarm device in accordance with claim 1, wherein the circuit board portion comprises a 0.032" FR4 double sided printed circuit board.

3. The alarm device in accordance with claim 1, wherein the circuit board portion includes a microcontroller, wherein the microcontroller is in electrical communication with the first electrical terminal, the second electrical terminal, and the audible alarm.

4. The alarm device in accordance with claim 1, wherein the product container is a digital data storage case for housing a CD or DVD.

5. The alarm device in accordance with claim 4, wherein the circuit board portion fits snugly within a central indention of the digital data storage case.

6. The alarm device in accordance with claim 1, wherein the audible alarm means comprises an amplifying unit and a piezo buzzer.

7. The alarm device in accordance with claim 6, wherein the piezo buzzer emits a minimum 80 dB sound at 4 KHz when the audible alarm is activated.

8. The alarm device in accordance with claim 1, wherein a position of the magnetically-operated pin selectively changes from a retracted position to the extended position responsive to applying external electromagnetic force to the switching unit in a first direction, and wherein the position of the magnetically-operating pin selectively changes from the extended position to the retracted position responsive to applying external electromagnetic force to the switching unit in a second direction.

9. The alarm device in accordance with claim 8, wherein the first direction is different than the second direction.

10. The alarm device in accordance with claim 9, wherein the external electromagnetic force applied in the second direction originates from a de-magnetizing station at a retail checkout stand.

11. The alarm device in accordance with claim 1, wherein a position of the magnetically-operated pin with respect to the ovate-shaped opening corresponds to an arming state of the alarm device.

12. The alarm device in accordance with claim 11, wherein the arming state is one of armed or disarmed, and wherein the alarm device can be reused by way of a resetting of the arming state.

13. The alarm device in accordance with claim 1, wherein the mounting base is rectangular in shape and comprises a plastic exterior.

14. The alarm device in accordance with claim 1, wherein the alarm device is battery-powered.

15. A method of installing and implementing the alarm device in accordance with claim 1, the method comprising:

placing the alarm device in the product container;

inserting product contents into the product container;

closing the lid;

arming the alarm device at an arming station, said arming comprising selectively retracting the magnetically-operated pin from the ovate-shaped opening while the lid firmly engages the nodule and the product container is in the closed state; and authorizing a user to open the product container by disarming the alarm device at a checkout stand, said disarming comprising extending the magnetically-operated pin into the ovate-shaped opening while the lid firmly engages the nodule and the product container is in the closed state.

16. The method in accordance with claim 15, further comprising sealing or shrink-wrapping the product container following closing the lid.

17. A method of detecting and deterring an unauthorized opening of a lid of a product container, the method comprising:

monitoring an open state and a closed state of the lid by way of an alarm device, the alarm device comprising:

a circuit board portion and a sensing unit mounted under the lid of the product container, the lid having an open state and a closed state detectable by the sensing unit;

an audible alarm mounted on the circuit board portion;

the sensing unit comprising:

first and second cantilevers that extend generally parallel to each other and outward from a mounting base, the first and second cantilevers comprising first anchored ends extending generally out of the mounting base and second non-anchored ends, the second non-anchored ends crisscrossed, bowed outwardly in a relatively opposed direction and crisscrossed again to form an ovate-shaped opening therebetween before finally ending parallel to each other again, the first cantilever at the second non-anchored end having a first electrical terminal and having a nodule on a top side thereof that abuts an inner surface of the lid when the product container is in the closed state and acts to push the first cantilever towards the second cantilever at the non-anchored ends, and wherein the second cantilever at the second non-anchored end comprises a second electrical terminal facing said first electrical terminal biased by the cantilevers in an electrically non-contacted state maintained so long as the lid is in the open state;

wherein if the lid is in the closed state, the lid presses against the nodule that in turn presses on the first cantilever's second non-anchored end such that the first and second facing electrical terminals are in an electrically-connected state;

a switching unit mounted on the circuit board portion and comprising a magnetically-operated pin capable of selectively extending into the ovate-shaped opening to lock the first and second electrical terminals of the first and second cantilevers into the electrically-connected state regardless of the open/closed state of the lid; and wherein if the switching unit does not have the magnetically-operated pin selectively extended into said ovate-shaped opening and the lid is opened, the first and second electrical terminals are in the electrically non-contacted state;

determining, by the alarm device, if the lid is in the unauthorized open state by determining if the first and second electrical terminals are in the electrically non-contacted state; and activating the audible alarm responsive to determining that the first and second electrical terminals are in the electrically non-contacted state.

* * * * *